United States Patent [19]

Schmidt

[11] Patent Number: 4,934,543

[45] Date of Patent: Jun. 19, 1990

[54] BOTTLE CAP AND DISPENSER

[76] Inventor: Andrew C. Schmidt, P.O. Box 30008, Phoenix, Ariz. 85046-0008

[21] Appl. No.: 347,669

[22] Filed: May 5, 1989

Related U.S. Application Data

[62] Division of Ser. No. 7/158,556, Feb. 22, 1988, abandoned.

[51] Int. Cl.[5] ..... B65D 83/14

[52] U.S. Cl. ..... 215/228; 222/399

[58] Field of Search ..... 222/396, 399; 215/4, 215/5, 228

[56] References Cited

U.S. PATENT DOCUMENTS 4,011,971 3/1977 Haydon ..... 222/399

4,473,174 9/1984 Heuser ..... 222/399 X

*Primary Examiner*—Stephen Marcus

*Assistant Examiner*—Christine A. Peterson

*Attorney, Agent, or Firm*—Jordan M. Meschkow; Don J. Flickinger; Lowell W. Gresham

[57] ABSTRACT

A pressurizing cap which may be readily attached and detached from the discharge neck of a bottle of carbonated liquid includes a housing having a first chamber proximate one end thereof and a skirt portion at an opposite end thereof which engages the bottle's neck. The first chamber retains a pressurized canister of innoxious gas such as carbon dioxide. The housing also comprises a second chamber. A first conduit leads from the first chamber to the second chamber, and a second conduit leads from the second chamber to the neck portion of the bottle. Means are provided within the second chamber for selectively connecting the first and second conduits whereby gas is released into the bottle. Liquid discharge means may also be provided which comprises a nozzle extending from the housing and a tube coupled at one end thereof to the nozzle and having an opposite end in communication with the liquid in the bottle. The cap is collinearaly mounted with the neck of the bottle.

7 Claims, 2 Drawing Sheets

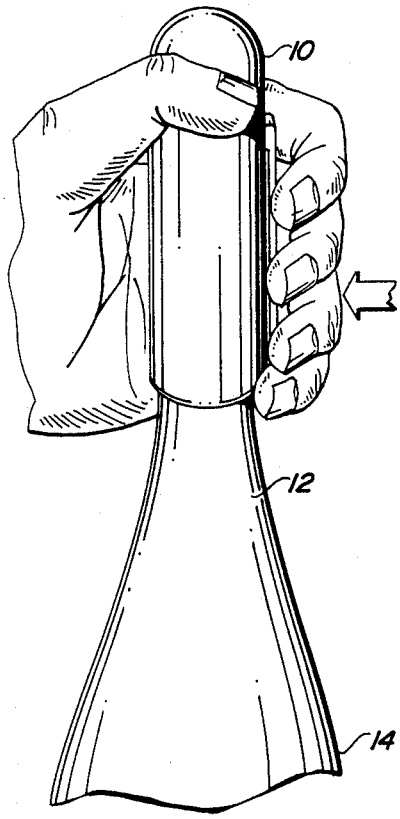
FIG. 1
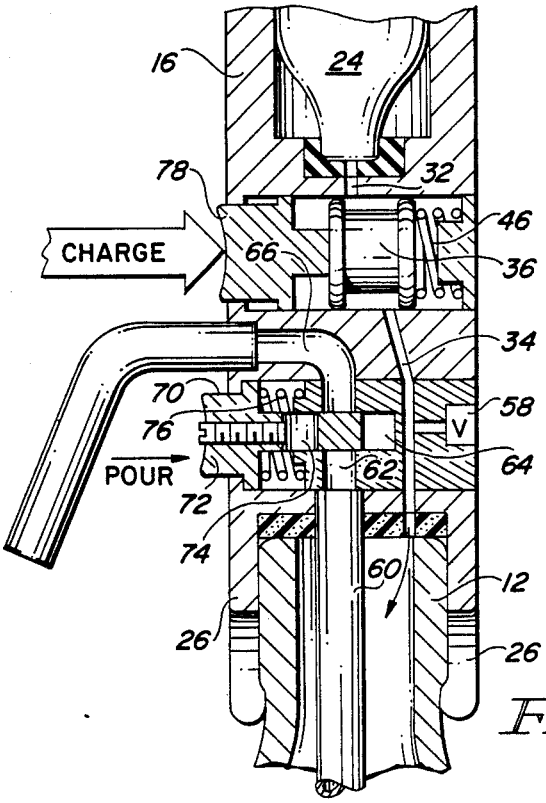
FIG. 6
FIG. 3
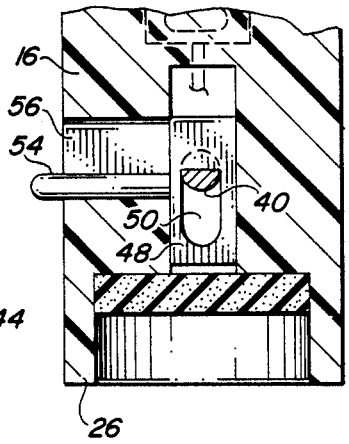
FIG. 4
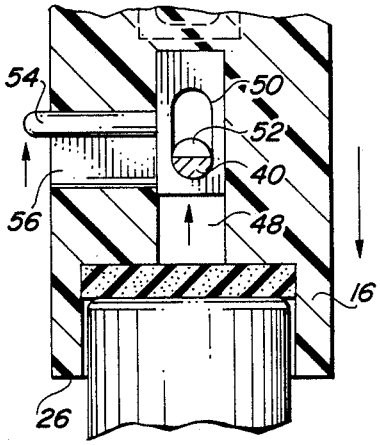
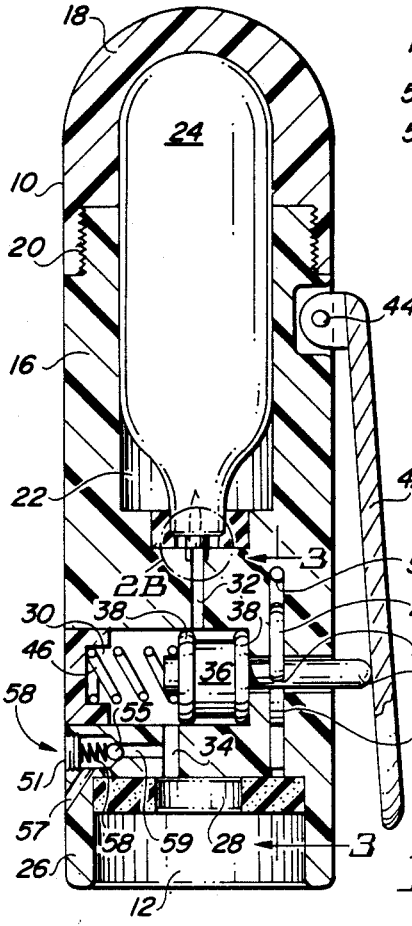
FIG. 2
FIG. 5
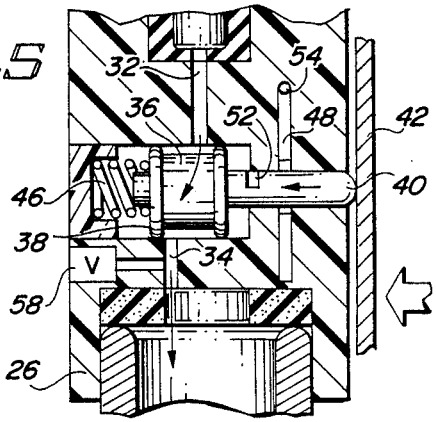

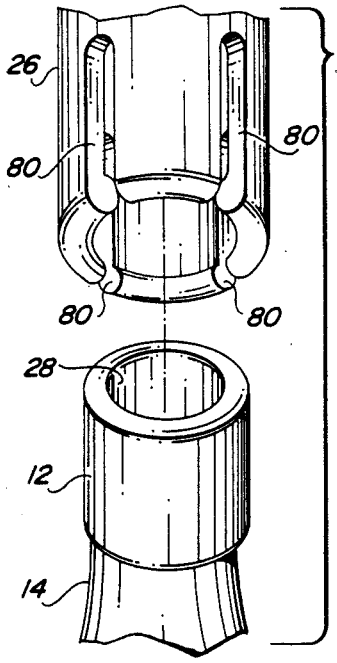
FIG. 7
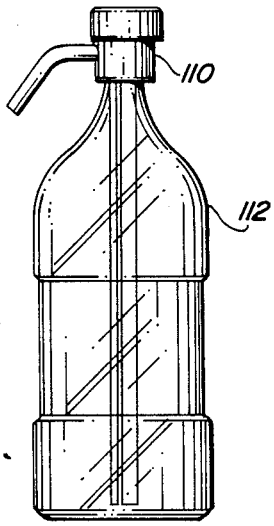
FIG. 9
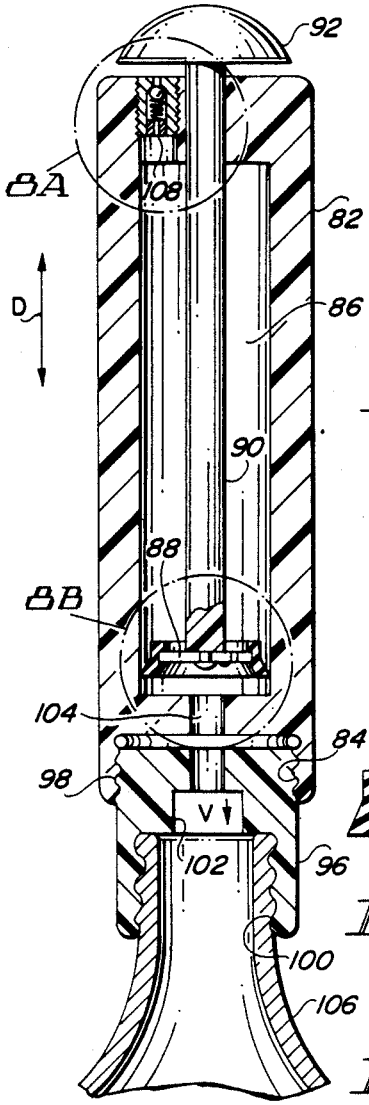
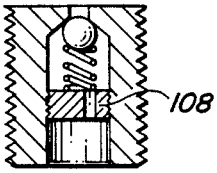
FIG. 8A
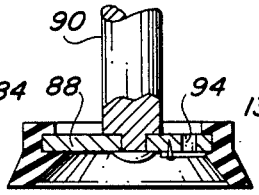
FIG. 8B
FIG. 8
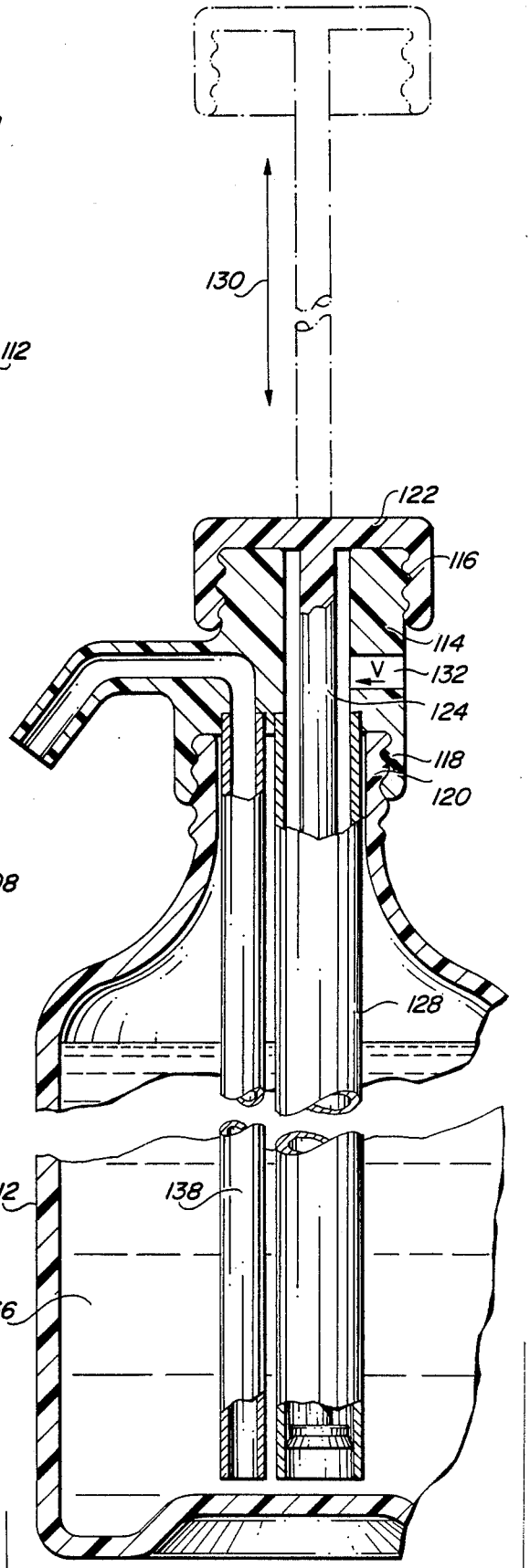
FIG. 10

BOTTLE CAP AND DISPENSER

This application is a division, of application Ser. No. 158,556, filed 22 Feb. 1988, now abandoned.

BACKGROUND OF THE INVENTION

Field of the Invention

This invention relates generally to a bottle cap and dispenser apparatus, and more particularly to a pressurizer and/or dispenser for use on a carbonated-liquid container such as a soft drink bottle.

Soft drinks marketed in one, two and three liter bottles cost less per ounce than that which is sold in cans and small bottles. Thus, families can spend less per serving and enjoy all the soft drink purchased provided that such multi-liter containers of soft drink can be stored after opening for long periods of time.

The most common problem associated with storing large bottles of soft drink as the contents thereof are being consumed, is that the carbon dioxide dissipates. That is, consumers of multi-liter soft drinks are often times disappointed by the flat or stale taste of the beverage sometime after the initial opening of the container.

Therefore, a need exists for an apparatus which may be used in conjunction with such multi-liter soft drink containers and which will successfully counter the above described negative effects. While dispensing and pressurizing devices are known (for example see U.S. Pat. Nos. 2,771,226; 3,018,022; and 4,011,971), a need still exists for such a device which is compact and convenient to use.

SUMMARY OF THE INVENTION

It is an object of the invention to provide an improved cap and pressurizer for use in conjunction with multi-liter containers of carbonated liquid such as soft drinks.

It is a further object of the present invention to provide an improved pressurizer cap and dispenser for use in conjunction with multi-liter containers of carbonated liquid such as soft drinks.

It is a still further object of the present invention to provide a dispensing and/or pressurizing apparatus which is compact and convenient to use.

According a broad aspect of the invention there is provided a pressurizing cap which may be readily attached and detached from the discharge neck of a bottle of carbonated liquid. The cap includes a housing having a first chamber proximate an upper end thereof and a skirt portion at an opposite lower end thereof which detachably engages the neck of the bottle. The first chamber retains a pressurized canister of innoxious gas. The second chamber is provided within the housing, and a first conduit extends from the first chamber to the second chamber. A second conduit extends from the second chamber to the neck portion. Means are provided within the second chamber for selectively connecting the first conduit to the second conduit whereby gas is released into the bottle. Fluid discharge means may also be provided and comprise a tube having an upper end proximate the housing and a lower end extending into the liquid, and a nozzle communicating with the upper end of the tube.

BRIEF DESCRIPTION OF THE DRAWINGS

The above and other objects, features and advantages of the invention will be better understood from the following detailed description taken in conjunction with the accompanying drawings in which:

FIG. 1 illustrates the inventive pressurizing cap positioned on the neck of a bottle containing carbonated liquid (not shown);

FIG. 2 is a cross-sectional view of the pressurizing cap shown in FIG. 1 wherein the operative mechanism is illustrated in a locked position;

FIG. 3 is a cross-sectional view taken along the line 3—3 of FIG. 2 showing a locking mechanism in a locked position;

FIG. 4 is a cross-sectional view taken along line 3—3 in FIG. 2 illustrating the locking mechanism in an unlocked position;

FIG. 5 is a cross-sectional view of the inventive pressurizing cap with the locking mechanism in an unlocked configuration;

FIG. 6 illustrates an alternate embodiment of the inventive pressurizing cap including liquid dispensing means;

FIG. 7 illustrates how the embodiment shown in FIG. 6 is positioned on the neck of a bottle;

FIG. 8 is a cross-sectional view of manual pressurizing apparatus in accordance with the present invention;

FIG. 8A is an enlarged view of the one-way valving apparatus taken from within the broken outline circle designated 8A in FIG. 8;

FIG. 8B is an enlarged view of the flapper-valve plunger apparatus taken from within the broken outline circle designated 8B in FIG. 8;

FIG. 9 illustrates a manual pressurizing and dispensing apparatus configured in accordance with the teachings of the present invention mounted on a bottle; and FIG. 10 is a cross-sectional view of the manual pressurizing and dispensing apparatus shown in FIG. 9.

DETAILED DESCRIPTION OF THE PREFERRED EMBODIMENT

FIG. 1 illustrates the inventive pressurizing bottle cap 10 being manually placed over the neck portion 12 of a bottle 14 containing carbonated liquid such as soft drink. As can be seen, the cap 10 is generally cylindrical having a longitudinal axis which is substantially colinear with that of neck portion 12.

FIG. 2 is a cross-sectional view of the pressurizing cap shown in FIG. 1. The housing 10 comprises a cylindrical portion 16 and a hemispherical portion 18. As can be seen, cylindrical housing portion 16 has an upper portion which is externally threaded so as to cooperate with an internally threaded lower portion of hemispherical portion 18 as is shown at 20. In this manner a chamber 22 is defined which retains a canister 24 of an innoxious gas such as carbon dioxide. Canister 24 may be replaced by simply unscrewing upper portion 18, removing the old spent canister, and inserting the new sealed, charged one. Cannister 24 is forced downwardly as hemispherical portion 18 is threaded on to cylindrical portion 16. Cannister 24 is punctured by hollow needle 32 as cannister 24 is forced downward.

Housing 10 includes a skirt portion 26 which may be placed over the neck portion 12 of bottle 14 which has an opening 28 through which the contents of bottle 14 normally flow. Skirt portion 26 is resilient so as to provide a tight fit between skirt portion 26 and neck 12.

A second chamber 30 is provided which communicates with the first chamber 22 via hollow needle 32 and with the interior of bottle 14 via conduit 34 in a manner to be described hereinbelow.

Positioned within chamber 30 is a piston 36 which has been provided with sealing rings 38 at its forward and rearward ends. A piston rod 40 is fixidly coupled to piston 36 and extends through the housing so as to be engaged by a handle 42 pivotally coupled to the housing as is shown at 44. Piston 36 is biased by spring 46 in the position shown in FIG. 2. It should be clear that in this position, gas from canister 24 can not be transferred into bottle 14 since piston 36 and sealing rings 38 cooperate to prevent gas from exiting hollow needle 32 and entering conduit 34. A locking lever 48 having a slot 50 therethrough communicates with a notch 52 in piston rod 40 so as to lock piston 36 in place. In this configuration, bringing pressure to bear on piston rod 40 via handle 42 will not result in movement of piston 36. Locking lever 48 may be moved upward to release piston 36 by means of member 54 which is accessible from the exterior of housing 10.

For safety, a release valve 58 is provided. Valve 58, typical of conventional ball check valves, comprises conduit 59 which communicates with conduit 34, cap 51, spring 53, ball 55, and conduit 57. When excessive pressure passes through conduit 34 it flows into conduit 59, ball 55 compresses spring 53, and allows excessive pressure to escape through conduit 57.

FIG. 3 illustrates the locking mechanism in more detail. As can be seen, locking lever 48 is slidably mounted within the housing and may be moved from a lower locking position shown in FIG. 3 to a raised unlocked position shown in FIG. 4 simply by raising member 54 which is fixidly coupled to locking lever 48 and extends through slot 56 to the exterior of the housing. With locking lever 48 raised as is shown in FIG. 4, piston 38 may be moved against the force of spring 46 by applying pressure on handle 42 which in turn forces piston rod 40 to the left. This situation is shown in FIG. 5. As can be seen, compressed gas from canister 24 may now pass through conduit 32, around piston 36, through conduit 34 and into the bottle. To prevent over-pressurization of the bottle, a release valve 58 is provided which will permit excessive gas in the bottle to escape to the housing exterior.

FIG. 6 illustrates an alternate embodiment of the present invention including a liquid discharge mechanism. Again, the resilient skirt 26 is press-fed on the upper neck portion 12 of a bottle 14. A tube 60 extends into the bottle and is in fluid communication with the liquid in the bottle. An opening 62 is couples the upper portion of tube 60 to chamber 64. An upper opening 66 couples chamber 64 to a nozzle 68 through which liquid may exit under pressure. A spring biased volume control mechanism 70 comprises a button portion 72 capable of being pressed by the user and includes an opening 74 therethrough which may be brought into varying degrees of alignment with conduits 62 and 66. That is, by manually pressing button 72 and compressing spring 76, opening 74 is brought into complete alignment with conduits 62 and 66 permitting a maximum amount of fluid to flow from nozzle 68. Anything less than complete compression of spring 76 will result in a reduced flow of liquid due to the lessor degree of alignment between opening 74 and conduits 62 and 66. Also, in this embodiment, handle 42 shown in FIG. 2 has been replaced by a button 78 which is pressed in order to charge the interior of the bottle with compressed gas.

FIG. 7 illustrates an alternate configuration of the skirt portion 26. As can be seen, slots 80 have been provided in the skirt portion so as to increase the resiliency of the skirt thus facilitating placement and removal of the cap on neck 12 of bottle 14.

FIG. 8 illustrates an alternate embodiment of the present invention. As can be seen, housing 82 has an internally threaded bore 84 at the lower end. A chamber 86 houses piston 88, and piston rod 90 which extends though an upper portion of housing 82 and is coupled to handle 92. By raising and lowering handle 92, piston 88 may be reciprocally moved from a lowered position to a raised position as indicated by the doubled arrowed line D. As piston 88 is moved upwardly air passes through one-way check valve, a flapper valve 94 as seen in greater detail with reference to FIG. 8B, to be compressed and urged into bottle 106 as piston 88 is subsequently moved downwardly. Concurrent with the downward movement of piston 88 air is drawn through check valve 108 into chamber 86. Check valve 108 generally similar to previously described valve 58, is better viewed in FIG. 8A.

Cap 96 includes an upper externally threaded portion 98 and a lower internally threaded portion 100. A one-way valve 102, similar to valve 108, is also contained in cap 96 and permits air to be forced from chamber 86 by piston 88 through conduit 104 and valve 102 into bottle 106. As can be seen, the upper external and the lower internal threads in cap 96 engage respectively the lower internally threaded portion 84 and the externally threaded neck of bottle 106.

FIG. 9 illustrates a still further embodiment of the inventive pressurizing and discharge cap 110 for use in conjunction with a multi-liter bottle 112. This embodiment is shown in more detail in FIG. 10 which is a cross-sectional view thereof. Again, a housing 114 having an externally threaded upper portion 116 and a lower internally threaded skirt 118 is secured to the neck portion 120 of bottle 112. An internally threaded cap portion 122 is coupled to a piston rod 124 which is in turn coupled to piston 126. Piston 126 is slidably moveable within cylinder 128. Thus cap portion 122 may be raised and lowered as is shown by dotted lines and arrow 130 so as to cause air which enters cylinder 128 via valve 132 to pass into bottle 112 via one way valve 94. This will in turn cause the contents 136 of bottle 112 to flow upward through tube 138 and exit nozzle 140. When not in use, cap 122 threadably engages the upper portion of the housing.

Various changes and modifications to the embodiments herein chosen for purposes of illustration will readily occur to those skilled in the art. For purposes of example only, it should be obvious to one skilled in the art when provided disclosure of the instant invention, that cap 96 could be used with pressurizing bottle cap 10, if bottle cap 10 had internal threads within skirt 26. Additionally many other one-way valves could be substituted for those disclosed herein. To the extent that such modifications and variations do not depart from the spirit of the invention, they are intended to be included within the scope thereof which is assessed only by a fair interpretation of the following claims.

Having fully described and disclosed the instant invention in such clear and concise terms as to enable those skilled in the art to understand and practice the same, the invention claimed is:

1. A pressurizing cap which may be readily attached and detached from the discharge neck of a bottle of carbonated liquid, said cap comprising:

a housing having a first chamber proximate an upper end thereof and a skirt portion at an opposite end thereof for detachably engaging said neck, said first chamber for retaining a pressurized canister of innoxious gas;

a second chamber within said housing;

a first conduit from said first chamber to said second chamber;

a second conduit from said second chamber to said neck portion; and valve means for selectively connecting said first conduit to said second conduit whereby said gas is released into said bottle, said valve means comprising a piston slidably coupled within said second chamber and capable of being maneuvered between a first position wherein communication between said first and second conduits is blocked and a second position wherein gas from said first conduit will flow through said second conduit;

a piston rod fixedly coupled to said piston and extending to the exterior of said housing;

spring means coupled within said chamber for normally biasing said piston into said first position; and a handle pivotally coupled to said housing and engaging said piston rod for moving said piston to said second position.

2. A pressurizing cap according to claim 1 further comprising means for locking said piston in said first position.

3. A pressurizing cap according to claim 2 wherein said locking means comprises:

a slot in said housing;

a notch in said piston rod;

a locking member slidably coupled in said slot for engaging said notch to lock said piston; and means coupled to said locking member and maneuverable from the exterior of said housing for unlocking said piston.

4. A pressurizing cap according to claim 2 further comprising a release valve in said housing through which excessive gas in said bottle may escape to the exterior of said housing.

5. A pressurizing cap according to claim 2 further comprising liquid discharge means extending from the interior of said bottle to the exterior of said housing.

6. A pressurizing cap which may be readily attached and detached from the discharge neck of a bottle of carbonated liquid, said cap comprising:

a housing having a first chamber proximate an upper end thereof and a skirt portion at an opposite end thereof for detachably engaging said neck, said first chamber for retaining a pressurized canister of innoxious gas;

a second chamber within said housing;

a first conduit from said first chamber to said second chamber;

a second conduit from said second chamber to said neck portion; and valve means for selectively connecting said first conduit to said second conduit whereby said gas is released into said bottle, said valve means comprising a piston slidably coupled within said second chamber and capable of being maneuvered between a first position wherein communication between said first and second conduits is blocked and a second position wherein gas from said first conduit will flow through said second conduit;

a piston rod fixedly coupled to said piston;

spring means coupled within said chamber for normally biasing said piston into said first position; and an actuator movably coupled to said housing and engaging said piston rod for moving said piston to said second position;

liquid discharge means extending from the interior of said bottle to the exterior of said housing, said liquid discharge means comprising a third chamber;

a first tube communicating at one end thereof with said third chamber and having an opposite end extending into said liquid;

a third conduit extending from said third chamber and communicating with an opening in said housing;

nozzle means extending from said opening to the exterior of said housing; and regulating means in said third chamber for regulating the volume of liquid passing through said liquid discharge means.

7. A pressurizing cap according to claim 6 wherein said regulating means comprises:

an adjustable alignment member having an opening therethrough; and means for varying the alignment of said opening with said third conduit and said tube.

* * * * *